US005280692A

United States Patent [19]

Patey

[11] Patent Number: 5,280,692

[45] Date of Patent: Jan. 25, 1994

[54] WATER SHIELD REINFORCING MEMBER FOR FLOOR JOISTS

[76] Inventor: Michael J. Patey, 1790 N. 550 West, Provo, Utah 84604

[21] Appl. No.: 21,133

[22] Filed: Feb. 23, 1993

[51] Int. Cl.[5] ..... C04D 13/00

[52] U.S. Cl. ..... 52/716.2; 52/731.1; 52/741.3; 52/97; 52/58

[58] Field of Search ..... 52/731.7, 731.1, 58, 52/97, 101, 716.2, 741.3, 746

[56] References Cited

U.S. PATENT DOCUMENTS

| | | | |
|---|---|---|---|
| Re. 28,870 | 6/1976 | Attaway et al. | 52/58 X |
| 494,848 | 4/1893 | Durkin . | |
| 2,165,500 | 7/1939 | Muirhead | 52/101 |
| 2,674,765 | 4/1954 | Tennison . | |
| 4,620,403 | 11/1986 | Field . | |
| 4,644,720 | 2/1987 | Schneider . | |
| 4,742,654 | 5/1988 | Cole . | |
| 4,848,049 | 7/1989 | Hanson . | |
| 4,858,399 | 8/1989 | Salato . | |
| 4,969,250 | 11/1990 | Hickman et al. | 52/58 X |
| 5,097,641 | 3/1992 | Hand et al. | 52/101 |
| 5,148,644 | 9/1992 | Weir | 52/58 X |
| 5,181,352 | 1/1993 | Friedman | 52/58 |

*Primary Examiner*—Carl D. Friedman
*Assistant Examiner*—Robert Canfield
*Attorney, Agent, or Firm*—Thorpe, North & Western

[57] ABSTRACT

A water shield, reinforcing device for insertion over a top edge of a joist member and useful for supporting a wood deck or other outdoor structure which may be exposed to water. The device includes an elongate channel of rectangular cross section which has a composition of sufficiently high modulus of elasticity to provide substantial inflexibility to the device. The width of the channel approximately corresponds to the width of the joist member and the height dimension is sufficient, in combination with the modulus of elasticity, to provide substantial inflexibility to the device. The length of the channel is coextensive and continuous with the length of the joist member and includes diverging wing members coupled at bottom ends and along the length of the elongate channel to direct water away from the joist member.

15 Claims, 1 Drawing Sheet

WATER SHIELD REINFORCING MEMBER FOR FLOOR JOISTS

BACKGROUND OF THE INVENTION

1. Field of the Invention

This invention relates to structural devices for protecting floor joist members from water damage. More particularly, the present invention relates to reinforcing floor joists used for deck structures which are exposed to the elements, and particularly to rain or snow.

2. Prior Art

Typical construction of quality deck flooring for outdoor applications requires use of redwood floor planks as deck surfacing. Redwood provides long term resistance to water damage, as well as an aesthetically appealing rustic appearance. Redwood, however, does not offer the degree of load bearing stiffness to provide good floor joist members. Consequently, fir or other more sturdy types of wood are selected for floor joists.

Although conventional wood floor joist members supply the required load bearing capacity, they are typically subject to water damage and will necessitate replacement long before the deck flooring is worn. Unfortunately, replacement of the floor joists generally results in removal of the redwood floor planks, often leading to damage which makes floor decking unsalvageable. Repair of supporting joists, therefore, is often tantamount to replacement of floor decking as well.

This problem has long been recognized, leading to various plastic devices for shielding water away from floor joists, particularly under decking surfaces. For example, U.S. Pat. No. 4,742,654 by Cole discloses a deck subflooring that comprises a top plate and diverging, arcuate side members that carry water away from the joist A second patent, U.S. Pat. No. 4,848,049, teaches a similar top plate with diverging wings which deflect away from the joist. These wings are flat, as opposed to curved. Each of these shielding devices rests on top of the plank and operates as a rain shed. There is no load-bearing function to this member U.S. Pat. No. 4,858,399 by Salato, teaches the use of a plastic channel with upward projecting ribs for aligning floor planks as a floor deck surface. There is no winged structure for shedding water away from the sides of the joist. To the contrary, water flows off the top plastic cover with the alignment ribs, and down the sidewalls of the joist. This water can seep under the plastic cap, as well as directly damage the exposed joist structure. This channel is formed of resilient polymer which allows the channel to be press fit onto the beam or joist. There is no load-bearing function to this member.

Other protective water shields are well known as part of the construction industry, such as various types of flashing and other forms of roofing protection. Protective shields for protecting foundations from water damage are disclosed in U.S. Pat. No. 494,848. Floor moisture barriers are shown in U.S. Pat. No. 4,644,720.

It appears to be common practice in the construction industry to isolate the problem of water damage, without consideration of other concurrent construction problems. This practice extends not only in the deck flooring field of construction, but through the other aspects of roof, wall and floor design. The lack of emphasis on structural reinforcement considerations within the cited prior art confirms this observation. Nevertheless, the increasing costs of construction and the highly competitive nature of this industry requires continual attention to balancing quality versus cost competitiveness.

What is needed, therefore, is a method of construction which provides benefits of both water barrier structure and enhanced reinforcement to flooring members. Reinforcement can reduce the cost of materials by allowing use of less material to reach the same level of strength. Concurrent focus on protection of these materials from water operates to preserve the materials, avoiding the need for early replacement. These and other benefits suggest an ongoing need for renewed attention to combining quality and economics with a common focus.

OBJECTS AND SUMMARY OF THE INVENTION

It is an object of this invention to provide a water shield device for use with deck flooring joists which not only shed water away from the joist member, but also reinforces or strengthens the joist.

It is a further object of this invention to provide an inexpensive shield for use with floor joists which is simple to manufacture and easy to install.

Yet another object of this invention is to provide a method and device for preserving the joist-work under a deck while strengthening the sturdiness of the floor construction.

These and other objects are realized in a reinforcing, water shield device for insertion over a top edge of a joist member of standard width. The invention includes an elongate channel of rectangular cross-section which has a composition of sufficiently high modulus of elasticity to provide substantial inflexibility to the device. The channel has a width dimension corresponding to the width of the joist member to which the device is to be attached. The channel has a height dimension sufficient, in combination with the modulus of elasticity of the channel to provide inflexibility to the device. Further, the channel has a length substantially coextensive and continuous with the length of the joist member. The channel also includes diverging wing members coupled to bottom ends and along the length of the elongate channel and is configured to extend outward from the joist member to direct water away from the joist member. Finally, means are provided for rigidly securing the device to a joist member which has been fully inserted within the channel.

Other objects and features of the present invention will be apparent to those skilled in the art, based on the following detailed description, taken in combination with the accompanying drawings.

DETAILED DESCRIPTION OF THE PREFERRED EMBODIMENT

Figure 1:
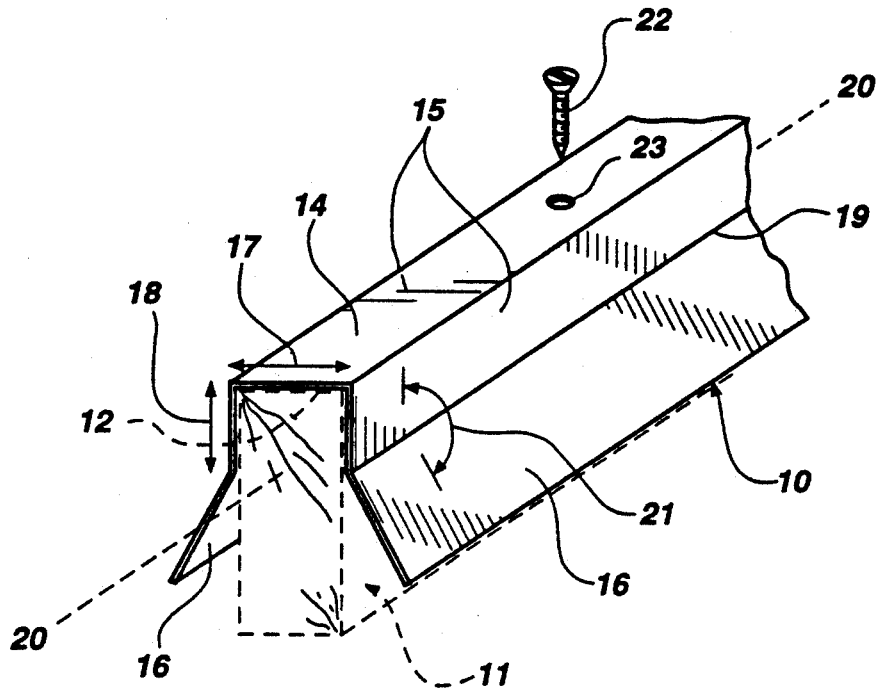
FIG. 1 shows a partial, perspective view of a reinforcing shield member in accordance with the inventive principles set forth herein, including a joist member illustrated in phantom line.

A reinforcing, water shield device 10 for insertion over a top edge 12 of a joist member 11 of standard width is shown in FIG. 1. The joist member 11 may be any beam typically used in support of flooring planks used in connection with construction of an outdoor structure such as a deck, which may be exposed to water. Although the present invention is designed for use with fir and other timber which is subject to water damage, it is uniquely adapted for use with softer woods such as redwood because of its capacity to reinforce the limited load-bearing nature of this wood.

The dimensions of the joist shown in FIG. 1 correspond to the measurements of standard a 2×4 (inches). The principles suggested in connection with this joist will apply to a 2×6 or other joist structural member as well. Because of the increased strength offered by the water shield device 10, a 2×4 structure is more suitable for floor joist use, whereas such timbers would typically be a second choice to 2×6 construction.

The preferred embodiment of the present water shield device 10 is an elongate channel of rectangular cross-section formed of a rigid metal, such as 28 gauge galvanized sheet metal. This configuration conforms to the rectangular configuration of the edge 12 of the joist to provide a snug fit when the joist is nested in the channel. The channel width dimension 17 corresponds to the width of the joist member to which the device is to be attached. This dimension 17 will be just slightly larger than the width of the joist member 11 to provide the recommended snug fit. For the 2×4 illustrated, the width dimension is approximately one and 9/16ths inch.

In addition to convenience of insertion and retention of the channel on the joist member, the snug fit and corresponding rectangular configuration of the channel provides a significant load-bearing function. As the channel is securely fixed around the edge of the joist, the rigidity of the metal channel supports the joist, reinforcing it against deflection under the load of the deck. This is in direct contrast to prior art references which recommend the use of flexible, resilient polymers.

Similarly, the channel height dimension 18 directly affects the stiffness of the channel. This height 18 needs to be sufficiently long, in combination with the modulus of elasticity and moment of inertia of the channel, to provide inflexibility to the device. Obviously, the stiffer and thicker the metal, the greater will be the stiffness along the longitudinal axis 20 of the channel. The 28 gauge sheet metal provides a favorable load-bearing function under normal circumstances. Normally, the height dimension will extend at least one-fourth the height of the joist member. For the 2×4 joist illustrated, the recommended height 18 of the channel is approximately 1 and ½ inches. Where increased load is anticipated, adjustments to the choice of rigid material, thickness and height will be appropriate and understood by those skilled in the art.

The channel has a length substantially coextensive and continuous with the length of the joist member. This can be accomplished with use of a continuous length of channel, or by overlapping several channel sections to form a continuous channel structure. This not only adds to the integrity of the channel as a load-bearing member, but also protects from the penetration of water through junctions which may not be totally sealed. Because of the convenience of working with long lengths of sheet metal, manufacture of channels of extended length does not pose a major difficulty.

To further increase the stiffness of the channel and increase protection against water access to the contained joist member, the channel includes diverging wing members 16. These are coupled to bottom ends 19 and along the length of the elongate channel. Generally, these wing members 16 are configured to extend outward from the joist member to direct water away from the joist member at an angle 21 in excess of 120 degrees. This angle is measured from the channel side 15 to the wing member 16. The preferred angle is 135 degrees.

Figure 2:
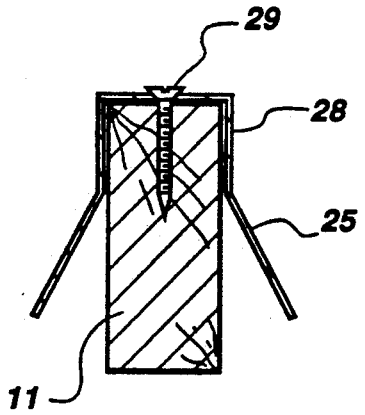
FIG. 2 discloses a geometric representation of an end view of the structure of FIG. 1.
Figure 3:
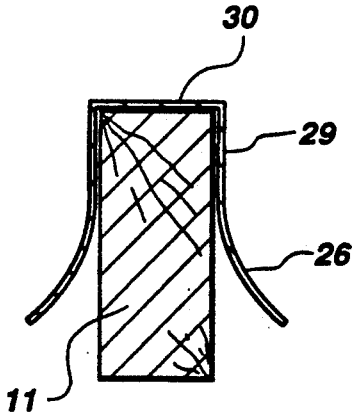
FIG. 3 shows a geometric representation of an end view of an additional embodiment of the present invention.

The configuration of the wing members 16 may be any diverging structure which sheds water away from the protected joist. For example, the diverging wing members may comprise flat flanges 25 as shown in FIG. 2, or arcuate flange members 26 as illustrated in FIG. 3. In each case, the wing members are coupled to lower ends of the channel 28 or 29; and will extend for a length of ½ inch or more. Typically, this will be at least ¼ the width of the joist member.

The channel device 10 is secured to the joist by a screw 22 and opening 23 to enable rigid interattachment. Alternate securing means can be provided by a nail 29 or adhesive 30.

These various components and features of the present invention are embodied in a method for protecting a floor support joist of a deck from water damage and for strengthening the joist member beyond its inherent stiffness which represented by the following procedural steps. The initial step involves selecting a floor joist member 11 which is to be included in subflooring support for the deck. An elongate channel 10 is then selected with comparable rectangular cross-section and diverging wing members which extend downward from bottom ends of the channel and which are capable of deflecting water away from a floor joist inserted within the channel. As previously indicated, this channel has a composition of sufficiently high modulus of elasticity and moment of inertia to provide substantial inflexibility to the channel. The next step involves inserting an edge of the floor joist within the channel in a seated position and to a sufficient depth to supply load bearing, beam support from the channel to the floor joist. Finally, the floor joist is rigidly secured in the seated position within the channel.

The surprising effectiveness of this rain shield in supplementing load capacity of a typical joist is illustrated in the following experimental data. A two-by-four of fir having a span of ten feet was suspended at its ends. With a load of 100 pounds positioned in the middle of the two-by-four, two-by-four in vertical orientation, nominal deflection was noted. Under a load of 300 pounds, the deflection was 2 and ⅜ inches. A load of 500 pounds broke the two-by-four. By applying the subject reinforcing water shield device as illustrated in the drawings, with dimensions of 1 and ½ inch width, 1 and ½ inch length on channel side walls, and wing members of ½ inch diverging at 135 degrees from the vertical channel wall, surprisingly improved results were noted. Under similar loading conditions, the 300 pound weight deflected the two-by-four less than ½ the distance (1 and 1/16 inch) as experienced with the unsupported two-by-four. Even more surprising is the fact that under a 500 pound load which broke the two-by-four when unsupported, the deflection was only 1 and 5/8 inches. In other words, the reinforcing structure of the present invention permitted a deflection of only 9/16 of an inch under a load of 500 pounds as compared to the 300 pound load. It will be apparent to those skilled in the art that the multiplied effect of using the subject reinforcing water shield not only will provide protection against weather, but will substantially increase the load bearing capacity of a deck, with only nominal increase in cost and very little additional labor. Accordingly, the present invention greatly strengthens the load bearing capacity of a deck and can extend the life of the original deck material by factor of several times. This translates into decreased cost during installation for a stronger deck structure, as well as cost savings by avoiding deck replacement with the passage of time.

It will be apparent that the foregoing that the examples specifically disclosed herein are for illustration and are not to be considered limiting, beyond the claims that follow.

We claim:

1. A reinforcing, water shield device for insertion over a top edge of a joist member as part of a wood deck structure, said deck structure including:

at least one joist member useful for supporting the wood deck or other outdoor structure which may be exposed to water;

an elongate channel of rectangular cross-section inserted around an upper edge of the joist member, and having a composition of sufficiently high modulus of elasticity so as to substantially add to the longitudinal rigidity of the joist member;

the channel having a width dimension corresponding to a width of a joist member;

a height dimension sufficient, in combination with the modulus of elasticity of the channel, to provide increased rigidity to the joist member;

the channel having a length substantially coextensive and continuous with the length of the joist member;

said channel including diverging wing members coupled to channel side walls and along the length of the elongate channel and being configured to extend outward from the joist member to direct water away from the joist member; and means for rigidly securing the device to a joist member which has been fully inserted within the channel.

2. A device as defined in claim 1, wherein the channel and diverging wing members are fabricated of rigid metal.

3. A device as defined in claim 1, wherein the channel and diverging wing members are fabricated of sheet metal having a gauge rating of approximately 28.

4. A device as defined in claim 1, wherein the width dimension is approximately one and ½ inch.

5. A device as defined in claim 1, wherein the height dimension extends at least one-fourth the height of the joist member.

6. A device as defined in claim 3, wherein the height dimension is at least 1 and ½ inches.

7. A device as defined in claim 1, wherein the diverging wing members comprise flat flange members which form an angle of at least 120 degrees with respect to the channel as measured with respect to the channel member.

8. A device as defined in claim 1, wherein the diverging wing members comprise arcuate flange members.

9. A device as defined in claim 1, wherein the diverging wing members extend away from an inserted joist member by at least ¼ the width dimension of the channel.

10. A device as defined in claim 1, wherein the means for securing the device to the joist member includes means for positioning a nail or screw through the channel and into the joist.

11. A device as defined in claim 1, wherein the means for securing the device to the joist member includes means for adhesively joining the channel and the joist.

12. A method for protecting a floor support joist member in a wood deck structure from water damage and for strengthening the joist member beyond its inherent stiffness, said method comprising:

a) selecting at least one floor joist member useful for supporting the wood deck or other structure which may be exposed to water, said joist member to be included in subflooring support;

b) selecting an elongate channel of comparable rectangular cross-section and diverging wing members extending downward from side walls of the channel which are capable of deflecting water away from the floor joist member when it is inserted within the channel, which channel has a composition of sufficiently high modulus of elasticity so as to substantially add to the longitudinal rigidity of said joist member when it is so inserted, which channel also has a width dimension corresponding to a width of the joist member and a height dimension sufficient, in combination with the modulus of elasticity of the channel, to provide increased rigidity to the joist member when it is so inserted;

c) inserting an upper edge of the floor joist member within the channel in a seated position and to a sufficient depth to supply load bearing, beam support from the channel to the floor joist; and d) rigidly securing the floor joist in the seated position within the channel.

13. A method as defined in claim 12, comprising the more specific step b) of selecting an elongate channel fabricated of a rigid metal composition.

14. A method as defined in claim 12, wherein step d) comprises the more specific step of securing screws through a top face of the channel and into the joist member to rigidly secure the floor joist in the seated position within the channel.

15. A method as defined in claim 12, wherein step d) comprises the more specific step of securing screws through a layer of flooring members, through a top face of the channel and into the joist member to rigidly secure the floor joist in the seated position with the top face of the channel sandwiched between the floor joist and flooring members.

* * * * *